United States Patent [19]

Borgis

[11] Patent Number: 5,008,587

[45] Date of Patent: Apr. 16, 1991

[54] ELECTRIC LAMP WITH IMPROVED LAMP CAP ASSEMBLY

[75] Inventor: Livio Borgis, Torino, Italy

[73] Assignee: U.S. Philips Corporation, New York, N.Y.

[21] Appl. No.: 567,413

[22] Filed: Aug. 14, 1990

[30] Foreign Application Priority Data

Aug. 28, 1989 [NL] Netherlands ..... 8902170

[51] Int. Cl.[5] ..... H01J 5/50; H01K 1/46

[52] U.S. Cl. ..... 313/318; 313/315

[58] Field of Search ..... 313/318, 315, 578, 579

[56] References Cited

U.S. PATENT DOCUMENTS 2,076,582 4/1937 Linder ..... 176/30
2,141,146 12/1938 Zabel ..... 176/30
3,243,634 4/1963 Mosby ..... 313/285
4,641,056 2/1987 Sanders et al. ..... 313/51
4,928,032 5/1990 Skoch et al. ..... 313/318

FOREIGN PATENT DOCUMENTS 1184300 3/1970 United Kingdom ..... 313/318

*Primary Examiner*—Sandra L. O'Shea
*Assistant Examiner*—John Giust
*Attorney, Agent, or Firm*—Robert J. Kraus

[57] ABSTRACT

The electric lamp has a hollow body (20) of synthetic material in its lamp cap (6), which screens a current supply conductor (11) extending to a base contact member (8) of the lamp cap from the shell portion (13) of the lamp cap (6). The body (20) has projections (22) distributed over it, which bear with clamping fit on the shell portion (13).

11 Claims, 4 Drawing Sheets

ELECTRIC LAMP WITH IMPROVED LAMP CAP ASSEMBLY

FIELD OF THE INVENTION

The invention relates to an electric lamp comprising a translucent lamp vessel with an end portion which comprises a sealed exhaust tube and a stemtube, a light source inside the lamp vessel, a lamp cap having an axis and contact members, which cap is fastened to the end portion of the lamp vessel by means of an adhesive compound, current supply conductors which extend from the light source to respective contact members at the lamp cap and are connected thereto, the lamp cap having a metal shell portion and a base portion of insulating material which carries at least one base contact member provided with an opening which issues into a channel through the base portion, through which channel a current supply conductor passes to the exterior, in the lamp cap a hollow body of synthetic material which extends from a first open end near the lamp vessel to the base portion of the lamp cap and screens or insulates the current supply conductor extending to the base contact member from the shell portion of the lamp cap.

DESCRIPTION OF RELATED ART

Such a lamp is known from GB 11 84 300 (1970-3-11). It is the purpose of the body of synthetic material in the lamp cap to prevent the current supply conductor to the base contact member coming into contact with the shell portion of the lamp cap or, alternatively, to prevent a discharge arc arising between the two. Such a contact or such a discharge arc can arise especially in lamps of relatively high power, when the current supply conductor melts through owing to the passage of a too high current. It is desirable to avoid these risks because otherwise the circuit breaker in the mains through which the lamp is fed can be triggered and/or the lamp cap can become welded to its lampholder.

A disadvantage of the known lamp is that the lamp vessel and the lamp cap have to be assembled with the lamp cap in bottom position in order to prevent the body of synthetic material dropping from the lamp cap or assuming a skew position in the lamp cap. After this assembly operation, the lamp must be turned upside down to bring the lamp cap up, so that the current supply conductor can be fastened to the base contact member. Another disadvantage is that the body of synthetic material, being an additional component to be assembled, must first be provided in the lamp cap during lamp assembly.

A similar lamp is known from U.S. Pat. No. 2,141,146 (1935-9-17), as well as a lamp in which the shell portion of the lamp cap is coated on the inside with an insulating compound. The compound may consist of the same material as the insulating material of the base portion, usually glass, and be integral with it. It has shown itself to be difficult, however, on the one hand to apply sufficient insulating material for ensuring the screening effect, while on the other hand not so much insulating material is applied that there is no certainty that the lamp cap will fit the end portion of the lamp vessel. When lamp caps with aluminium shell portions are used, moreover, the use of the relevant insulating material for coating the shell portion is not possible, because the lamp cap is heated too much during the application of this material, so that the shell portion becomes too soft and loses its shape. The same disadvantages hold for the lamp caps disclosed in this U.S. Patent which have a coating of cured cement.

GB 1 139 266 (1969-01-08) discloses a lamp obtained with the use of a lamp cap in which a ring is pressed of a material which forms a foam when heated. This lamp has the disadvantage that the foam may have become degenerated and pulverised at the end of lamp life after operation at comparatively high temperature. It was also found to be necessary to check the lamp cap for the presence of the foam ring before the lamp is assembled. Another disadvantage of the lamp is that, after foaming of the material and curing of the foam, rifts may be present in the foam which still render the shell portion accessible for a discharge arc.

A general disadvantage of the use of lamp caps which deviate from normal lamp caps is that such deviating, more expensive lamp caps must be kept in stock specially for the manufacture of lamps of relatively high power ratings which involve the risks referred to above.

U.S. Pat. No. 2 076 582 (1937-04-13) discloses a lamp in which the current supply conductor to the base contact member is surrounded by a sleeve of insulating material. A disadvantage of this is that an extra component must be provided during the assembly of lamp cap and lamp vessel.

SUMMARY OF THE INVENTION

The invention has its object to provide a lamp of the type described in the opening paragraph which, among other characteristics, is of a simple and reliable construction and which is easy to manufacture.

According to the invention, this object is achieved in that the body of synthetic material has outward projections which are distributed over its circumference and bear with clamping fit on the shell portion of the lamp cap.

It is achieved through the presence of the projections that the body of synthetic material is held by the lamp cap, irrespective of tolerances in the dimensions of the lamp cap and the body of synthetic material. The lamp cap with the body of synthetic material inside can thus be subjected to various manipulations without losing this body. Consequently, it is possible not only to provide the lamp cap in the usual manner on a lamp vessel with its base portion pointing upwards, but also to provide the body of synthetic material in standard lamp caps outside the lamp production line, depending on whether the lamp production requires the use of protected lamp caps. A favourable effect of the projections is that the adhesive compound, for example the cement compound, can make contact with the open end of the body of synthetic material at the inside and at the outside. The resulting close connection between the adhesive compound and the body of synthetic material leads to a reliable screening of the current supply conductor from the shell portion of the lamp cap by the body of synthetic material.

In a favourable embodiment the projections are axially extending fins. These may become narrower towards the shell portion of the lamp cap so that the body of synthetic material adapts itself easily to the lamp cap as regards its dimensions when this body is introduced into the lamp cap.

It is favourable if the body of synthetic material has a portion which becomes gradually narrower towards the channel in the base portion of the lamp cap. The current supply conductor which is to be passed through this channel is then automatically guided towards this channel when the lamp cap is being provided.

In many lamp types, the channel in the base portion and the opening in the base contact member are wide relative to the diameter of the current supply conductor. One of the causes of this is that the metal plate which forms the base contact member is provided with an opening by breaking out the material of the plate towards the interior. This leads to a jagged rim around the opening, which rim is embedded and anchored in the insulating material of the base portion in order to retain the plate.

When liquid metal is deposited on the base contact member in order to secure the current supply conductor to this member, there is a risk of liquid metal, for example solder, running through the opening into the channel and even into the lamp cap. No good fastening may be obtained then for lack of, for example, solder. In lamps without a body of synthetic material in the lamp cap, solder leaking away may form a wire of solder inside the lamp cap, which wire may short-circuit the lamp.

In a favourable embodiment, the body of synthetic material has an elongation, for example a conical or cylindrical one, which extends into the channel in the base portion. The body thus reduces the effective channel passage and obstructs the flowing away of liquid metal.

In lamp caps having two base contact members, the body of synthetic material preferably has two cavities which become gradually narrower substantially from the open-end portion towards the relevant channel, one for each current supply conductor. This renders unnecessary the use of hollow needles which are inserted through the respective channels and through which respective current supply conductors are guided into the interior before the lamp cap is lowered onto the lamp vessel. In this way the needles guide the current supply conductors through the channels.

In a very favourable embodiment, the body of synthetic material has a tube which accommodates one current supply conductor together with the exhaust tube and extends, for example, from outside the lamp cap to the base portion of the lamp cap.

The advantage of this embodiment lies in the restriction of the possibility of a discharge arc striking inside the space delimited by the lamp cap as a result of melting-through of a current supply conductor at the end of lamp life and leaping over to the other current supply conductor. If that risk should arise nevertheless, the tube, which is necessarily narrow because of the restricted space around the exhaust tube, quickly ensures that the discharge arc extinguishes.

In a modification of this embodiment, the tube has a tight connection to the gradually narrowing portion of the body of synthetic material. More in particular, the tube surrounds the exhaust tube substantially completely. This can be realised in spite of dimensional tolerances by not providing the body of synthetic material into the lamp cap up to the smallest possible distance from the base portion, so that during mounting of the lamp cap on the lamp vessel the lamp vessel itself, if necessary, presses the body of synthetic material more deeply into the lamp cap the moment the tube hits against the lamp vessel. This modification can be used especially if the body of synthetic material has an elongation which extends into the channel.

In another modification the tube has a mechanically weak, for example, flexible or knock-off end portion which easily adapts itself to the lamp vessel.

It will be clear that, if a body of synthetic material has a tube which surrounds a current supply conductor from the outside, this current supply conductor will be very effectively screened from the shell of the lamp cap. The cement compound need not make contact with the body of synthetic material for that purpose.

The lamp according to the invention may be an incandescent lamp or a discharge lamp, in which the light source is an incandescent body or a discharge arc, respectively, possibly arranged in an inner envelope.

The body of synthetic material may be made of, for example, thermoplastic resins, for example polypropylene oxide, polyphenylene sulphide, polyamide imide, polyimide, polyether sulphon and polyether imide, generally, synthetic materials which withstand the normal operating temperature of the lamp cap.

BRIEF DESCRIPTION OF THE DRAWINGS

Embodiments of the lamp according to the invention are shown in the drawings, in which.

DESCRIPTION OF THE PREFERRED EMBODIMENTS

Figure 1:
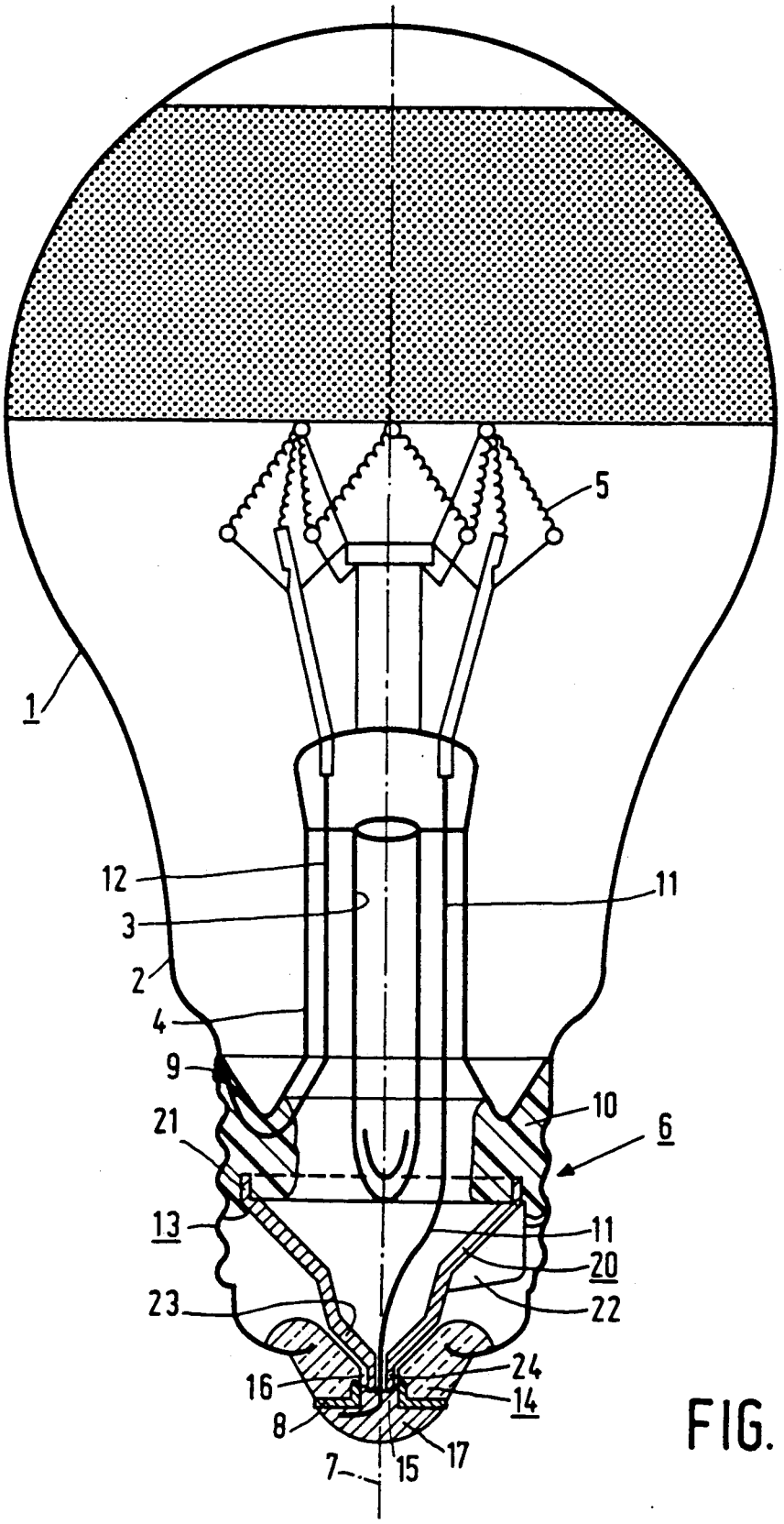
FIG. 1 is a first embodiment in side elevation with the lamp cap in axial cross-section.

The electric lamp of FIG. 1 has a translucent lamp vessel 1 with an end portion 2, which comprises a sealed exhaust tube 3 and a stemtube 4. A light source 5, an incandescent body, is positioned in the lamp vessel.

A lamp cap 6 of the E27 type having an axis 7 and provided with contact members 8, 9 is secured to the end portion 2 of the lamp vessel 1 by means of an adhesive compound 10, capping cement in the drawing.

Current supply conductors 11, 12 extend from the light source to respective contact members 8, 9 of the lamp cap 6 and are secured to them, in the drawing with solder 17 to base contact member 8.

The lamp cap 6 has a metal shell portion 13, which at the same time forms a contact member 9, and a base portion 14 of insulating material, glass in the drawing, which carries at least a base contact member 8 which is provided with an opening 15 issuing into a channel 16 through the base portion 14. A current supply conductor 11 emerges through this opening 15 and this channel 16 to the exterior.

A hollow body 20 of synthetic material is present in the lamp cap 6 and extends towards the base portion 14 of the lamp cap 6. The body 20 of synthetic material screens the current supply conductor 11 extending to the base contact member 8 from the shell portion 13 of the lamp cap 6. A first open end 21 of this body is in contact with the adhesive compound 10.

The body 20 of synthetic material has outward projections 22 (see also FIG. 4), which are distributed over its circumference and bear with clamping fit on the shell portion 13 of the lamp cap 6. In the Figures, the projections 22 are axially extending fins, which become narrower towards the shell portion 13 of the lamp cap 6.

The body 20 of synthetic material has a portion 23 which gradually becomes narrower towards the channel 16 in the base portion 14, and an elongation 24 which extends into said channel.

Figure 2:
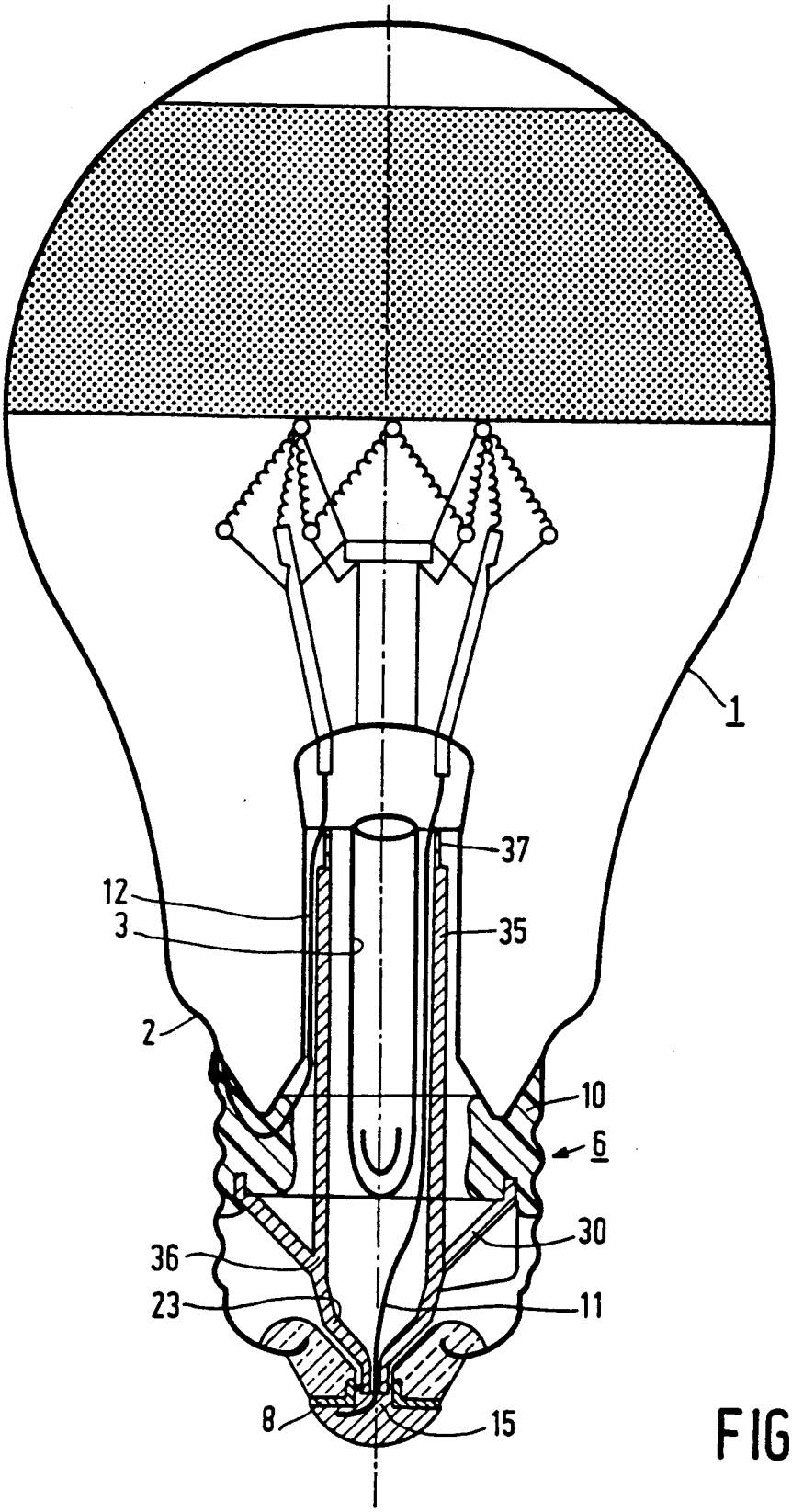
FIG. 2 is a second embodiment represented in the same way.

In FIG. 2, corresponding parts have the same reference numerals as those in FIG. 1. The hollow body 30 of synthetic material has a tube 35 which accommodates one current supply conductor 11 together with the exhaust tube 3. The tube 35 has a tight connection 36 to the gradually narrowing portion 23 of the body 30 of synthetic material. The tube 35 completely surrounds the exhaust tube 3. Near the lamp vessel 1, the tube 35 has a mechanically weakened free-end portion 37, whose wall thickness decreases gradually towards the end. The current supply conductor 11 is thus completely separated from the other conductor 12.

Figure 3:
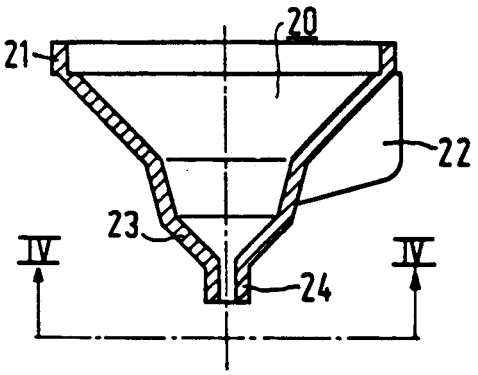
FIG. 3 is the body of synthetic material from FIG. 1 in axial cross-section.
Figure 4:
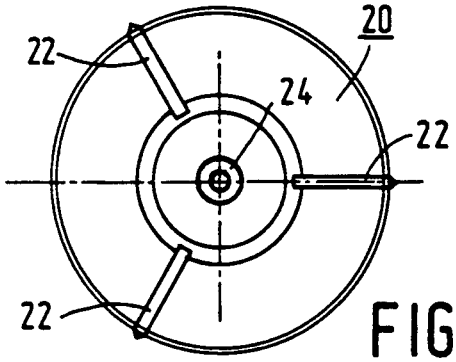
FIG. 4 is the same body of synthetic material taken on the line IV—IV.

The body 20 of synthetic material from FIG. 1 is represented separately in FIGS. 3 and 4. The body has three projections 22 distributed over its circumference and is suitable for an E27 lamp cap.

Figure 5:
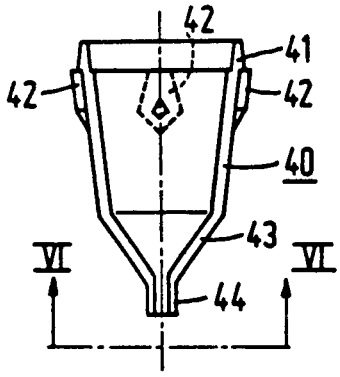
FIG. 5 is a second body of synthetic material in axial cross-section.
Figure 6:
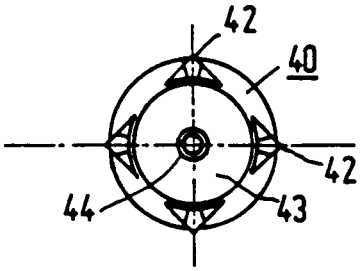
FIG. 6 is the body from FIG. 5 taken on the line VI—VI.

The body 40 of synthetic material in FIGS. 5 and 6 has parts with reference numerals which are 20 higher than those of corresponding parts in FIGS. 3 and 4. the body has four projections 42 and is suitable for use in an E14 lamp cap.

Figure 7:
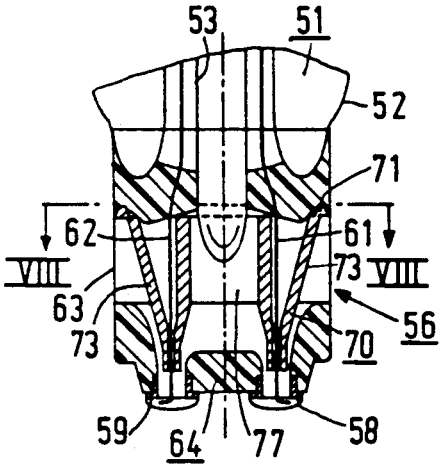
FIG. 7 is a lamp cap in axial cross-section.
Figure 8:
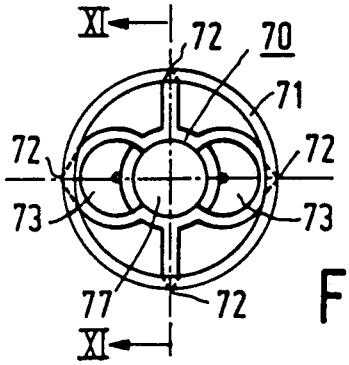
FIG. 8 is the body of synthetic material from FIG. 7 taken on the line VIII—VIII.

In FIGS. 7 and 8, parts corresponding to parts of FIG. 1 have reference numerals which are 50 higher. The lamp has a lamp vessel 51 with a B15 lamp cap 56, which has two contact members 58, 59 at its base portion 64. The hollow body 70 of synthetic material inside the lamp cap 56 has two gradually narrowing portions 73, one for each of the current supply conductors 61, 62. The portions 73 extend from the open end 71 of the body 70 of synthetic material. The body has an opening 77, through which the sealed exhaust tube 53 is passed.

Figure 9:
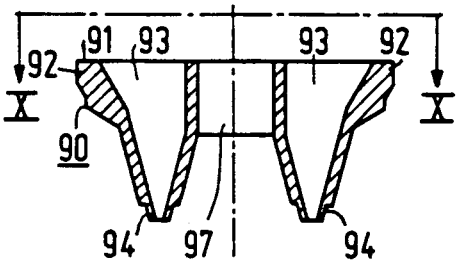
FIG. 9 is another body of synthetic material in axial cross-section.
Figure 10:
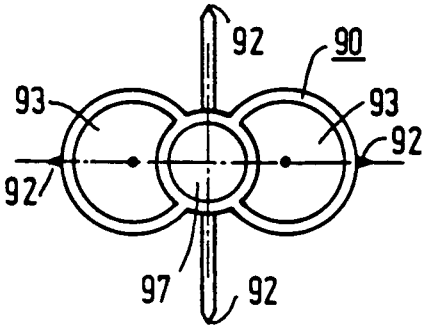
FIG. 10 is the body from FIG. 9 taken on the line X—X.

In FIGS. 9 and 10, parts of the body of synthetic material corresponding to parts in FIGS. 7 and 8 have reference numerals which are 20 higher. The body 90 of synthetic material is designed for use in a B22 lamp cap.

Figure 11:
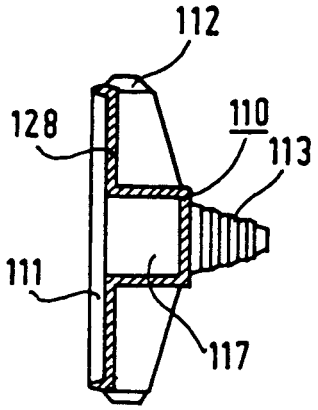
FIG. 11 is a modification of the body of FIG. 8 in axial cross-section corresponding to an axial cross-section taken on the line XI–XI.

The body 110 of synthetic material of FIG. 11, in which reference numerals are 40 higher than those of corresponding parts in FIG. 8, differs from the body in FIG. 8 in that a transverse wall 128 is present which causes the open end 111 to connect to the gradually narrowing portions 113, but leaves a cavity 117 free to accommodate an exhaust tube.

Figure 12:
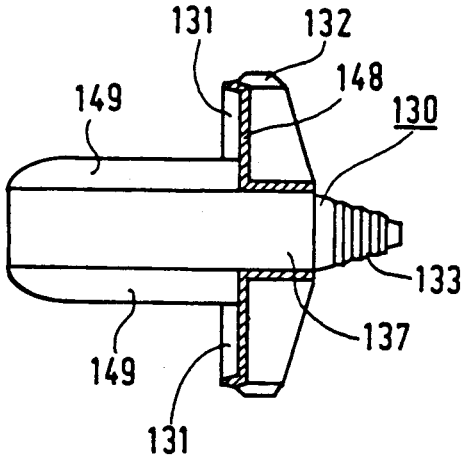
FIG. 12 is a modification of FIG. 11.

In FIG. 12, the body 130 of synthetic material is a modification of the body 110 of FIG. 11 with reference numerals which are 20 higher than those of corresponding parts in FIG. 11. A tube 137 extends to outside the open end 131 in order to surround an exhaust tube and comprises radial partitions 149. The tube 137 with its partitions 149 splits up the space inside a stemtube of a lamp vessel and allots to each current supply conductor present therein a space separated from that of the other one.

I claim:

1. An electric lamp comprising a translucent lamp vessel (1) with an end portion (2) which comprises a sealed exhaust tube (3) and a stemtube (4), a light source (5) inside the lamp vessel, a lamp cap (6) having an axis (7) and contact members (8, 9), which cap is fastened to the end portion of the lamp vessel by means of an adhesive compound (10), current supply conductors (11, 12) which extend from the light source to respective contact members (8, 9) at the lamp cap and are connected thereto, the lamp cap (6) having a metal shell portion (13) and a base portion (14) of insulating material which carries at least one base contact member (8) provided with an opening (15) which issues into a channel (16) through the base portion, through which channel a current supply conductor (11) can pass to the exterior, in the lamp cap, a hollow body (20) of synthetic material which extends from a first open end (21) near the lamp vessel (1) to the base portion (14) of the lamp cap (6) and insulates the current supply conductor (11) from the shell portion (13) of the lamp cap, characterized in that the body (20) of synthetic material has outward projections (22) which are distributed over its circumference and bear with clamping fit on the shell portion (13) of the lamp cap (6).

2. An electric lamp as claimed in claim 1, characterized in that the projections (22) are axially extending fins.

3. An electric lamp as claimed in claim 1 or 2, characterized in that the projections (22) become narrower in the direction of the shell portion (13) of the lamp cap (6).

4. An electric lamp as claimed in claim 1 or 2, characterized in that the body (20) of synthetic material has a portion (23) which becomes gradually narrower in the direction of the channel (16) in the base portion (14).

5. An electric lamp as claimed in claim 4, characterized in that the body (20) of synthetic material has an elongation (24) which extends into the channel (16) in the base portion (14).

6. An electric lamp as claimed in claim 1 or 2 characterized in that the body (30) of synthetic material has a tube (35) which accommodates a current supply conductor (11) together with the exhaust tube (3).

7. An electric lamp as claimed in claim 6, characterized in that the tube (35) has a tight connection (36) to the gradually narrowing portion (23) of the body (30) of synthetic material.

8. An electric lamp as claimed in claim 7, characterized in that the tube (35) surrounds the exhaust tube (13) substantially completely.

9. An electric lamp as claimed in claim 8, characterized in that the tube (35) has a mechanically weakened free-end portion (37) near the lamp vessel (1).

10. An electric lamp as claimed in claim 7, characterized in that the body (20) of synthetic material has an elongation (24) which extends into the channel (16) in the base portion (14) of the lamp cap (6).

11. An electric lamp as claimed in claim 4, characterized in that the lamp cap (56) has two base contact members (58, 59), and that the body (70) of synthetic material has a gradually narrowing portion (73) for each current supply conductor (61, 62), which portion extends substantially away from the first open end (71).

* * * * *